US005995126A

United States Patent [19]

Imai

[11] Patent Number: 5,995,126

[45] Date of Patent: Nov. 30, 1999

[54] APPARATUS AND METHOD FOR RECORDING THERMAL IMAGE

[75] Inventor: Shinji Imai, Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/848,659

[22] Filed: Apr. 29, 1997

[30] Foreign Application Priority Data

Apr. 30, 1996 [JP] Japan ..... 8-108944

[51] Int. Cl.[6] ..... B41J 29/17

[52] U.S. Cl. ..... 347/171; 400/701

[58] Field of Search ..... 347/171; 400/701, 400/702; 29/17

[56] References Cited

U.S. PATENT DOCUMENTS

| | | | |
|---|---|---|---|
| 4,947,190 | 8/1990 | Mizusawa et al. | 347/33 |
| 5,220,355 | 6/1993 | Miyawaki | 347/199 |
| 5,227,844 | 7/1993 | Bhattacharjee et al. | 399/99 |
| 5,560,980 | 10/1996 | Sakaki et al. | 428/195 |
| 5,563,646 | 10/1996 | Fukuda | 347/171 |

FOREIGN PATENT DOCUMENTS

| | | | |
|---|---|---|---|
| 0 531 992 | 3/1993 | European Pat. Off. | B41J 29/17 |
| 0 581 344 | 2/1994 | European Pat. Off. | B41J 22/165 |
| 8809610 | 11/1988 | Germany . | |
| 406166193A | 6/1994 | Japan | B41J 2/32 |
| 2 238 510 | 6/1991 | United Kingdom | B41J 2/165 |
| 92/04990 | 4/1992 | WIPO | B08B 1/02 |
| WO 93/21020 | 10/1993 | WIPO | B41J 29/17 |

OTHER PUBLICATIONS

IBM Technical Disclosure Bulletin, vol. 26, No. 38, Aug. 1983, pp. 1586–1587, XP002036827; Bowlds et al.; "Automatic Printhead Cleaner".

Patent Abstracts of Japan; vol. 12, No. 424 (M–761) [3271], 11/10;88 & JP 63 159075 A (Sharp Corp), Jul. 1, 1988* Abstract.

Patent Abstracts of Japan; vol. 13, No. 577 (M–910) [3925], Dec. 20, 1989 & JP 01 242278 A (Canon Inc), Sep. 27, 1989* Abstract.

*Primary Examiner*—N. Le
*Assistant Examiner*—Anh T. N. Vo
*Attorney, Agent, or Firm*—Sughrue, Mion, Zinn, Macpeak & Seas, PLLC

[57] ABSTRACT

The improved thermal image recording apparatus and method have a cleaning mode in which after a specified number of image prints have been produced, the thermal head is cleaned by delivering the thermal recording material without applying energy to the thermal head or with low energy below a specified value being applied to the thermal head. The improved thermal image recording apparatus and method are capable of removing stain from the thermal head before it adheres tenaciously to the head. These offer also the advantage of eliminating the need on the part of the user to perform a special maintenance program, and the cleaning operation performed with the apparatus and the method of the invention is less noisy than in the case of using the lapping film.

9 Claims, 2 Drawing Sheets

APPARATUS AND METHOD FOR RECORDING THERMAL IMAGE

BACKGROUND OF THE INVENTION

This invention relates to a thermal image recording apparatus (hereunder referred to as a "thermal recording apparatus") with which an image corresponding to image data is formed on a thermal recording material (hereunder referred to as a "thermal material") using a thermal head. This invention also relates to a thermal image recording method.

Thermal materials comprising a thermal recording layer on a paper or film substrate are commonly used to record images produced in diagnosis by ultrasonic scanning. This recording method, commonly referred to as thermal image recording, eliminates the need for wet processing and offers several advantages including convenience in handling. Hence, the use of the thermal image recording system is not limited to small-scale applications such as diagnosis by ultrasonic scanning and an extension to those areas of medical diagnoses such as CT, MRI and X-ray photography where large and high-quality images are required is under review.

As is well known, the thermal recording apparatus uses the thermal head having a glaze in which heat generating elements corresponding to the number of pixels of one line are arranged in one direction and, with the glaze a little pressed against the thermal recording layer of the thermal material, the thermal material is relatively moved in a direction approximately perpendicular to the direction in which the heat generating elements are arranged, and the respective heat generating elements of the glaze are heated in accordance with the image data to be recorded to heat the thermal recording layer, thereby accomplishing image reproduction.

When the thermal material is pressed under the heated thermal head, the heat-sensitive substances, the lubricant and other substances in the thermal recording layer are fused on the surface to permit image reproduction. Hence, with the continued image recording, stain and the fusion products of the lubricant and other substances in the thermal recording layer tend to accumulate on the surface of the thermal head and unevenly recorded images will occur if the excessive accumulation of the fusion products gets stuck between the thermal material and the thermal head.

In addition, the fusion products adhering to the surface of the thermal head will gradually increase in the strength of adhesion as they are kept heated with the thermal head and in some cases, they will stick so tenaciously that they cannot be easily removed by means of liquid detergent or other cleaning solutions. If the tenacious substances are difficult to remove by the cleaning operation, the only practical way to be adopted has been to scrape off the deposits from the surface of the thermal head by a suitable means such as a lapping film having a strong abrasive effect.

The lapping film has an abrasive such as alumina particles buried in the surface of a substrate film and the deposits adhering tenaciously to the surface of the thermal head can be scraped off by delivering this lapping film in place of the thermal material. However, the abrasive effect of the lapping film is so great as to remove the protective ceramic coating on the thermal head and, hence, the thermal head will wear prematurely before the end of its expected service life.

The lapping film has the advantage of being able to remove any tenacious stain and deposits but, on the other hand, the application of the lapping film is very noisy and, hence, is not suitable in hospitals.

As a further problem, the user has to perform periodic maintenance of the thermal recording apparatus, which is simply a waste of time.

SUMMARY OF THE INVENTION

The present invention has been accomplished under these circumstances and has as an object providing a thermal image recording apparatus and method that are capable of periodically removing stains which adhered to the thermal head, without performing maintenance by means of a lapping film, and preventing stains from sticking on the thermal head.

To achieve the above object, the invention provides a thermal image recording apparatus with which an image print corresponding to image data is produced on a thermal recording material by means of a thermal head, said apparatus having a cleaning mode in which after a specified number of image prints have been produced, said thermal head is cleaned by delivering said thermal recording material without applying energy to said thermal head or with low energy below a specified value being applied to said thermal head.

It is preferred that said cleaning mode is such that no energy is applied to said thermal head, thereby allowing said thermal recording material to be delivered with no image recorded thereon.

It is also preferred that said cleaning mode is such that low energy below a specified value is applied to said thermal head, thereby allowing said thermal recording material to be delivered with a full-frame image being recorded at low density below a specified value.

It is also preferred that said cleaning mode is such that said thermal recording material is delivered with an image of a specified pattern recorded thereon, said image consisting of a blank that was produced by applying no energy to said thermal head and an area which records an image of low density below a specified value by supplying said thermal head with low energy below a specified value.

It is further preferred that said cleaning mode is actuated either automatically or manually.

It is also further preferred that said apparatus further has means for switching said cleaning mode between automatically activating and manually activating.

It is still further preferred that said apparatus has means for controlling a thermal image recording operation of said apparatus, and said controlling means controls said cleaning mode.

It is also further preferred that said controlling means controls said automatically activating on the cleaning mode.

The invention also provides a method for thermal image recording comprising the steps of:

producing an image corresponding to image data on a thermal recording material by means of a thermal head; and actuating a cleaning mode in which said thermal head is cleaned by delivering said thermal recording material without applying energy to said thermal head or with low energy below a specified value being applied to said thermal head, after a specified number of image prints have been produced.

DETAILED DESCRIPTION OF THE INVENTION

The thermal image recording apparatus (hereunder referred to as a "thermal recording apparatus") and the thermal image recording method of the invention will now be described in detail with reference to the preferred embodiments shown in the accompanying drawings.

Figure 1:
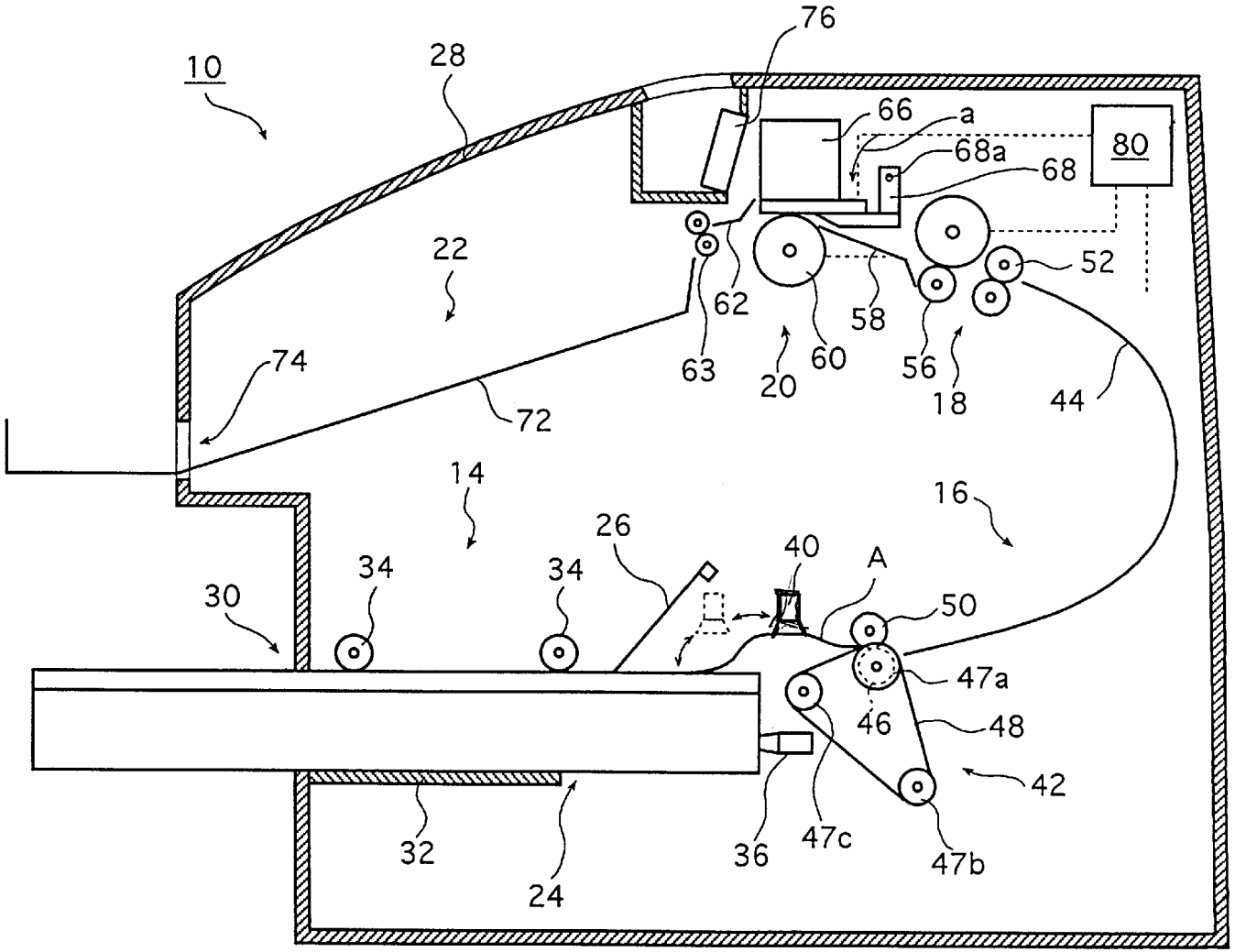
FIG. 1 shows conceptually an example of the thermal image recording apparatus of the invention carrying out the thermal image recording method of the invention.

FIG. 1 shows schematically an example of the thermal recording apparatus of the invention carrying out the thermal image recording method of the invention. The thermal image recording apparatus generally indicated by 10 in FIG. 1 performs thermal image recording on thermal recording materials of a given size, say, B4 (namely, thermal recording films A, which are hereunder referred to as "thermal films A"). The apparatus comprises a loading section 14 where a magazine 24 containing thermal films A is loaded, a feed/transport section 16, a recording section 20 performing thermal image recording on thermal films A by means of the thermal head 66, an ejecting section 22, and means 80 for controlling the thermal image recording operation of the thermal recording apparatus 10.

The thermal films A comprise respectively a substrate consisting of a transparent film such as a transparent polyethylene terephthalate (PET) film, which is overlaid with a thermal recording layer. Such thermal films A are stacked in a specified number, say, 100 to form a bundle. The thermal films A are accommodated in the magazine 24, and taken out of the magazine 24 one by one to be used for thermal image recording.

The loading section 14 has an inlet 30 formed in the housing 28 of the thermal recording apparatus 10, a guide plate 32, guide rolls 34 and a stop member 36.

The magazine 24 is inserted into the thermal recording apparatus 10 via the inlet 30 of the loading section 14 in such a way that the portion fitted with the cover 26 is coming first; thereafter, the magazine 24 as it is guided by the guide plate 32 and the guide rolls 34 is pushed until it contacts the stop member 36, whereupon it is loaded at a specified position in the thermal recording apparatus 10.

The feed/transport section 16 has the sheet feeding mechanism using the sucker 40 for grabbing the thermal film A by application of suction, transport means 42, a transport guide 44 and a regulating roller pair 52 located in the outlet of the transport guide 44; the thermal films A are taken out of the magazine 24 in the loading section 14 and transported to the recording section 20.

The transport means 42 is composed of a transport roller 46, a pulley 47*a* coaxial with the roller 46, a pulley 47*b* coupled to a rotating drive source, a tension pulley 47*c*, an endless belt 48 stretched between the three pulleys 47*a*, 47*b* and 47*c*, and a nip roller 50 that is to be pressed onto the transport roller 46.

When a signal for the start of recording is issued, the cover 26 of the magazine 24 is opened by the OPEN/CLOSE mechanism (not shown) in the thermal recording apparatus 10. Then, the sheet feeding mechanism using the sucker 40 picks up one sheet of thermal film A from the magazine 24 and feeds the forward end of the sheet to the transport means 42 (to the nip between rollers 46 and 50).

At the point of time when the thermal film A has been pinched between the transport roller 46 and the nip roller 50, the sucker 40 releases the film, and the thus fed thermal film A is supplied along the transport guide 44.

At the point of time when the thermal film A to be used in recording has been completely ejected from the magazine 24, the OPEN/CLOSE mechanism closes the cover 26. The distance between the transport means 42 and the regulating roller pair 52 which is defined by the transport guide 44 is set to be somewhat shorter than the length of the thermal film A in the direction of its transport. The advancing end of the thermal film A first reaches the regulating roller pair 52 by the transport means 42. The regulating roller pair 52 are normally at rest. The advancing end of the thermal film A stops here.

When the advancing end of the thermal film A reaches the regulating roller pair 52, the temperature of the thermal head 66 is checked and if it is at a specified level, the regulating roller pair 52 start to transport the thermal film A, which is transported to the recording section.

The recording section 20 has the thermal head 66, a platen roller 60, a fan 76 for cooling the thermal head 66, a cleaning roller pair 56, a guide 58, a guide 62, and a transport roller pair 63.

As shown, the thermal head 66 performs thermal image recording at a recording (pixel) density of, say, 300 dpi. The head comprises a thermal head body having a glaze in which the heat generating elements performing one line thermal recording on the thermal film A are arranged in one direction, and a heat sink fixed to the thermal head body. The thermal head 66 is supported on a support member 68 that can pivot about a fulcrum 68*a* either in the direction of arrow a or in the reverse direction.

The platen roller 60 rotates at a specified image recording speed while holding the thermal film A in a specified position, and transports the thermal film A in the direction approximately perpendicular to the direction in which the glaze extends.

The cleaning roller pair 56 comprises a sticky rubber roller and a non-sticky roller.

Before the thermal film A is transported to the recording section 20, the support member 68 has pivoted to UP position (in the direction opposite to the direction of arrow a) so that the glaze of the thermal head 66 is not in contact with the platen roller 60.

When the transport of the thermal film A by the regulating roller pair 52 starts, said film A is subsequently pinched between the cleaning roller pair 56 and transported as it is guided by the guide 58.

When the advancing end of the thermal film A has reached the record START position (i.e., corresponding to the glaze), the support member 68 pivots in the direction of arrow a and the thermal film A becomes pinched between the glaze on the thermal head 66 and the platen roller 60 such that the glaze is pressed onto the recording layer while the thermal film A is transported in the direction of arrow b by means of the platen roller 60, the regulating roller pair 52 and the transport roller pair 63 as it is held in a specified position by the platen roller 60.

During this transport, the individual heat generating elements on the glaze are actuated imagewise to perform thermal image recording on the thermal film A. After the end of thermal image recording, the thermal film A as it is guided by the guide 62 is transported by the platen roller 60 and the transport roller pair 63 to be ejected into a tray 72 in the ejecting section 22. The tray 72 projects exterior to the thermal recording apparatus 10 via the outlet 74 formed in the housing 28 and the thermal film A carrying the recorded image is ejected via the outlet 74 for takeout by the operator.

Having this basic construction, the thermal recording apparatus of the invention operates in the above-described manner by means of the controlling means 80 during the thermal image recording (mode) and will operate in the following manner during a cleaning mode.

First, the operation of the apparatus during cleaning of the thermal head 66 and the thermal image recording method of the invention will be described.

The thermal recording apparatus of the invention which is generally indicated by 10 is adapted to have the "cleaning mode" in which the thermal film A is delivered as a cleaning film for the thermal head 66 after a specified number of image prints, say, 100 prints, have been produced; the delivery of the thermal film A may be accomplished in various ways such as by delivering it with no image recorded, or with an image of a predetermined density recorded, or with an image of a predetermined density and pattern recorded.

The outermost surface of the thermal film A has pigment particles incorporated to form a protective coat on the film. The pigment is a solid substance that will not be fused by the heat generated from the thermal head 66 and it is incorporated in the outermost surface of the thermal film A in such a way that when the thermal film A is heated with the thermal head 66, the latter will not be blocked through adhesion to thereby ensure that a normal image can be recorded on the thermal film A in the thermal recording apparatus 10.

As just mentioned above, the inherent function of the pigment is to ensure that the heated thermal head 66 will not be blocked by adhesion to the thermal film A to which it is being pressed. In other words, during normal image recording on the thermal film A, the polymeric film which is the support of the thermal film A is in a softened state, so the pigment which is a solid substance inherently lacks the abrasive effect of the lapping film even if it is incorporated in the outermost surface layer of the thermal film.

However, if the thermal film A is delivered with no energy applied to the thermal head 66 (i.e., without heating it), the polymeric film which is the support of the thermal film A remains in a hardened state and the pigment, which is very hard compared to the polymeric film although not as hard as the alumina particles buried in the surface of the lapping film, will become effective as a kind of lapping film having a weak abrasive power.

Therefore, the higher the temperature of the thermal head 66, the more will the polymeric film that is the support of the thermal film A soften to thereby reduce the abrasive effect of the thermal film A.

Conversely, the lower the temperature of the thermal head 66, the more will the polymeric film which is the support of the thermal film A harden to thereby increase the abrasive effect of the thermal film A, enabling it to be used as a cleaning film having a less abrasive effect than the lapping film.

Figure 2A:
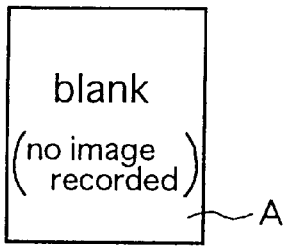
FIGS. 2*a*, 2*b* and 2*c* show conceptually three examples of a cleaning film which is delivered in a "cleaning mode"

Take, for example, the cleaning mode shown in FIG. 2*a*, where the thermal film A has been delivered without heating the thermal head 66 at all, namely, with no image recorded; since the polymeric support film is in the most hardened state, the thermal film A will function as a cleaning film that relies upon the pigment particles to provide a comparatively weak abrasive effect capable of removing the surface deposit on the thermal head 66 by a thickness of less than a hundred angstroms.

Figure 3:
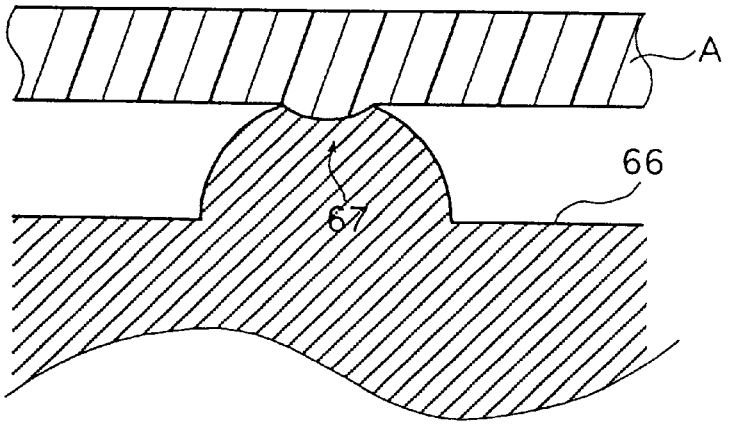
FIG. 3 shows conceptually a typical case of a worn heat generating element in a thermal head.

Thus, the thermal film A can be used not only as a thermal material capable of recording a desired image but also as a cleaning film having a weak abrasive effect which is variable with the temperature of the thermal head 66. Therefore, even in the case of normal image recording, the thermal head 66 will experience gradual wear of the protective ceramic coat and the wear may occasionally be as great as to form a concave 67 in a heat generating element (see FIG. 3).

Figure 2B:
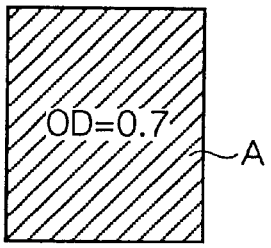

In a case like this, the cleaning mode shown in FIG. 2*b* may be selected and low energy not exceeding a specified level is applied to the thermal head 66 or it is heated to a specified low temperature or less such that the thermal film A is delivered with a full-frame image being recorded to give a specified transmission density (OD), which is 0.7 in the illustrated case. As a result, the polymeric support film softens to some extent and the pigment particles incorporated in the outermost surface layer of the thermal film A can penetrate deep into the concave 67 in a heat generating element on the thermal head 66, thereby achieving complete removal of any stain that has been deposited on the inner surface of the concave 67.

The wear of the thermal head 66 usually varies from one heat generating element to another. To deal with this situation, the cleaning mode showing FIG. 2*c* may be selected, in which the energy to be applied to the thermal head 66 is varied across the center line of the thermal film A such that it is delivered with a two-step varied density pattern recorded which consists of a black area and an area recorded to a transmission density of 0.7 in the illustrated case. In this way, the hardness of the polymeric support film varies across the center line of the thermal film A and not only the stain deposited on the surface of a heat generating element having no concaves formed thereon but also the stain deposited on the inner surface of the concave 67 in another heat generating element can be completely removed.

In a preferred embodiment, the density and pattern to be recorded on the thermal film A are determined appropriately by ensuring that the energy to be applied to the thermal head 66 is set below a specified limit at which the thermal film A will develop a sufficient abrasive effect to work as a cleaning film and the value of actual setting depends on various factors including the extent of stain of the thermal head 66, the wear of individual heat generating elements, the constituent material and thickness of the polymeric film (i.e., support of the thermal film A) and the thermal recording layer, as well as the constituent material and structural design of the thermal head 66.

Figure 2C:
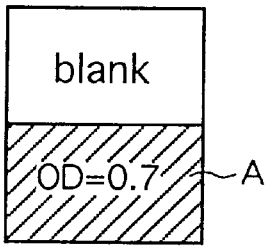

In the case shown in FIG. 2*c*, the thermal film A has a two-step varied density pattern but this is not the sole case of the present invention and the density may be varied progressively within the density range commonly used with the thermal recording apparatus 10 such as to provide a pattern having the density varied in many steps. It is preferred to deliver a thermal film A having at least two areas, one being blank and having no image recorded and the other having an image recorded to a low density below a specified level.

In a preferred embodiment, the cleaning mode is performed in the above-described manner by means of the controlling means 80.

In the thermal recording apparatus of the invention, the cleaning mode is actuated automatically at regular intervals and it is preferred to adapt the apparatus to have an additional capability for actuating the cleaning mode manually at any desired time. In a preferred embodiment, the thermal recording apparatus of the invention comprises switching means for switching the cleaning mode between the automatically actuating and the manually actuating. Also, it is preferred that the cleaning mode automatically actuated is controlled by the control means 80 controlling the operation of the apparatus 10.

With the thermal recording apparatus of the invention having the structural features described above, the thermal film A may be delivered as a cleaning film at regular intervals, say, one sheet after the delivery of 100 normal sheets and this is effective in removing the deposited stain from the thermal head 66 before it adheres tenaciously to the latter, thereby ensuring that there will be no tenacious stain deposit on the thermal head 66 in any circumstances. As a further advantage, the present invention eliminates the need to perform maintenance of the thermal recording apparatus using a lapping film and due to the less abrasive effect of the cleaning film as compared with the lapping film, the thermal head can be cleaned in a reasonably quiet manner.

Various image corrections are performed with the thermal recording apparatus and they include tone correction which intends to compensate for the difference between the image density to be produced and the density of the actually reproduced image, as well as shading correction which compensates for any unevenness in the actually reproduced image and in some of these corrections, it is necessary to output actually reproduced images of a specified density and pattern. In this respect, it is preferred for the thermal recording apparatus of the invention to eliminate the wastage of the thermal film A and realize its effective use by delivering it during the cleaning mode and using it as a recorded image that is required in certain types of image correcting process.

The foregoing example of the invention concerns the case where one sheet of cleaning film is delivered after 100 image prints have been produced; this is not the sole case of the thermal recording apparatus of the invention and it is preferred to adapt the apparatus such that it delivers one sheet of cleaning film after any specified number of image prints have been produced. It should also be noted that the thermal film A to be delivered as a cleaning film is not limited in any particular way and the first of the thermal films A contained in the magazine 24, or any desired film which follows it or the last film in the magazine may be delivered as a cleaning film; alternatively, a certain film may be delivered upon each magazine replacement. Furthermore, it should be noted that in a preferred embodiment, the control unit sets the thermal recording apparatus into the cleaning mode after detecting a predetermined number of printed thermal recording material films after the thermal recording apparatus was last set into the cleaning mode, after detecting the replacement of the magazine or stack of thermal recording films A in the loading section or store 14, or after detecting a predetermined number of printed thermal recording material films after the replacement of the magazine or stack of thermal recording material films in the loading section or store.

On the foregoing pages, the thermal image recording apparatus and method of the invention have been described in detail by reference to the specified embodiments of the thermal recording apparatus, but the present invention is in no way limited to the stated embodiments and various improvements and modifications can of course be made without departing from the spirit and scope of the invention.

As described above in detail, the thermal image recording apparatus and method of the invention are adapted to have a cleaning mode in which after a specified number of image prints have been produced, the thermal head is cleaned without applying energy to the head or with low energy below a specified value being applied to the head, thereby producing an image of a specified density and pattern on the thermal recording material.

Hence, the thermal image recording apparatus and method of the invention are capable of removing stain from the thermal head before it adheres tenaciously to the head and this enables the thermal head to be kept clean throughout the operation of the recording apparatus. In addition, compared with the case of removing the adhering stain by means of a highly abrasive lapping film during each maintenance operation, the recording apparatus of the invention periodically removes the stain deposit with the aid of a weakly abrasive thermal film so that the stain will not adhere permanently to the thermal head. This offers the advantage of eliminating the need on the part of the user to perform a special maintenance program and, further in addition, the cleaning operation performed with the apparatus and the method of the invention are less noisy than in the case of using the lapping film.

What is claimed is:

1. A thermal image recording apparatus having a cleaning mode comprising:

a thermal head for printing on a thermal recording material film an image corresponding to image data;

a store for storing a replaceable stack of thermal recording material films;

a transport mechanism for delivering the thermal recording material films from said store to said thermal head;

a control unit for setting said thermal recording apparatus into the cleaning mode after detecting one of a predetermined number of printed thermal recording material films after said thermal recording apparatus was last set into said cleaning mode, a replacement of the stack of thermal recording material films in said store, and a predetermined number of printed thermal recording material films after the replacement of the stack of thermal recording material films in said store;

wherein said thermal image recording apparatus, when set to said cleaning mode, delivers a new thermal recording material film from said store to said thermal head for cleaning said thermal head without applying energy to said thermal head or with a low energy below a specified value being applied to said thermal head, said control unit further controlling the energy applied to said thermal head.

2. A thermal image recording apparatus according to claim 1, wherein said cleaning mode is such that no energy is applied to said thermal head, thereby allowing said new thermal recording material film to be delivered with no image recorded thereon.

3. A thermal image recording apparatus according to claim 1, wherein said cleaning mode is such that said low energy below a specified value is applied to said thermal head, thereby allowing said new thermal recording material film to be delivered with a full-frame image being recorded at a low density below a specified value.

4. A thermal image recording apparatus according to claim 1, wherein said cleaning mode causes said new thermal recording material film to be delivered to said thermal head, and said thermal head to print an image of a specified pattern recorded thereon, said image consisting of a blank area that is produced by applying no energy to said thermal head and an area which records an image of low density below a specified value by supplying said thermal head with said low energy below a specified value.

5. A thermal image recording apparatus according to any one of claims 1–4, further comprising a switching device connected to said control unit for switching the image recording apparatus between a manual model for manually setting said thermal recording apparatus to the cleaning mode and an automatic mode for automatically setting said thermal recording apparatus to the cleaning mode after detecting said one of the predetermined number of printed thermal recording material films after said thermal recording apparatus was last set into said cleaning mode, the replacement of the stack of thermal recording material films in said store, and the predetermined number of printed thermal recording material films after the replacement of the stack of thermal recording material films in said store.

6. A thermal image recording apparatus according to claim 5, wherein said control unit controls said automatic mode for automatically setting said thermal recording apparatus to the cleaning mode.

7. A method for thermal image recording using a thermal image recording apparatus, comprising the steps of:

producing an image corresponding to image data on a thermal recording material film delivered from a replaceable stack of thermal recording material films in a store located in the thermal image recording apparatus, said image produced by means of a thermal head of the thermal image recording apparatus; and actuating a cleaning mode in which said thermal head is cleaned by delivering a new thermal recording material film from the stack of thermal image recording material films in the store to said thermal head without applying energy to said thermal head or with low energy below a specified value being applied to said thermal head after one of a predetermined number of printed thermal recording material films have been produce since a last actuation of the cleaning mode, a replacement of the stack of thermal recording material films in the store, and a predetermined number of thermal recording material films images after the replacement of the stack of thermal recording material films in said store.

8. A thermal image recording apparatus having a cleaning mode comprising:

a thermal head for printing on a thermal recording material film an image corresponding to image data;

a store for storing a replaceable stack of thermal recording material films;

a transport mechanism for delivering the thermal recording material films from said store to said thermal head;

a control unit for setting said thermal recording apparatus into a cleaning mode after detecting one of a predetermined number of printed thermal recording material films after said thermal recording apparatus was last set into the cleaning mode, a replacement of the stack of thermal recording material films in said store, and a predetermined number of printed thermal recording material films after the the replacement of the stack of thermal recording material films in said store;

wherein said thermal image recording apparatus, when set to said cleaning mode, delivers a new thermal recording material film from said store to said thermal head for cleaning said thermal head over a full-frame image area of the new thermal recording material film without applying energy to said thermal head or with a low energy below a specified value being applied to said thermal head, said control unit controlling the energy applied to said thermal head.

9. A method for thermal image recording using a thermal image recording apparatus, comprising the steps of:

producing an image corresponding to image data on a thermal recording material film delivered from a replaceable stack of thermal recording material films in a store located in the thermal image recording apparatus, said image produced by means of a thermal head; and actuating a cleaning mode in which said thermal head is cleaned over a full-frame image area of a new thermal recording material film from the stack of thermal image recording material films in the store by delivering said new thermal recording material film to said thermal head without applying energy to said thermal head or with low energy below a specified value being applied to said thermal head after one of a predetermined number of printed thermal recording material films have been produce since one of a last actuation of the cleaning mode, a replacement of the stack of thermal recording material films in the store, and a predetermined number of printed thermal recording material films after the replacement of the stack of thermal recording material films in said store.

* * * * *